US010724528B2

(12) United States Patent
Bigi et al.

(10) Patent No.: US 10,724,528 B2
(45) Date of Patent: Jul. 28, 2020

(54) COOLING SYSTEM FOR COOLING A MOTORCOMPRESSOR UNIT

(71) Applicant: Nuovo Pignone Tecnologie SRL, Florence (IT)

(72) Inventors: Manuele Bigi, Florence (IT); Luciano Mei, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 165 days.

(21) Appl. No.: 15/576,059

(22) PCT Filed: May 19, 2016

(86) PCT No.: PCT/EP2016/061271
§ 371 (c)(1),
(2) Date: Nov. 21, 2017

(87) PCT Pub. No.: WO2016/188854
PCT Pub. Date: Dec. 1, 2016

(65) Prior Publication Data

US 2018/0156223 A1 Jun. 7, 2018

(30) Foreign Application Priority Data

May 22, 2015 (IT) ..... 102015000016887

(51) Int. Cl.
*F04D 25/06* (2006.01)
*F04D 29/058* (2006.01)
(Continued)

(52) U.S. Cl.
CPC ..... *F04D 25/0606* (2013.01); *F04D 13/14* (2013.01); *F04D 25/0686* (2013.01);
(Continued)

(58) Field of Classification Search
CPC ..... F04D 13/00; F04D 13/02; F04D 13/06; F04D 13/0653; F04D 13/08;
(Continued)

(56) References Cited

U.S. PATENT DOCUMENTS

2012/0017636 A1 1/2012 Wada et al.
2012/0107143 A1* 5/2012 Gilarranz ..... F04D 25/0606 417/53

(Continued)

FOREIGN PATENT DOCUMENTS

JP H07-35045 A 2/1995

OTHER PUBLICATIONS

Italian Search Report and Written Opinion issued in connection with corresponding IT Application No. 102015000016887 dated Jan. 12, 2016.

(Continued)

*Primary Examiner* — Patrick Hamo
*Assistant Examiner* — Chirag Jariwala
(74) *Attorney, Agent, or Firm* — Baker Hughes Patent Organization

(57) ABSTRACT

A cooling system for cooling an integrated, high pressure, motorcompressor unit, the cooling system including a second motorcompressor unit and at least a first duct fluidly connecting a process fluid connection point located at the second motorcompressor unit to at least one process fluid injection point located at the first motor area of the first motorcompressor unit.

6 Claims, 4 Drawing Sheets

(51) Int. Cl.
*F04D 29/58* (2006.01)
*F04D 13/14* (2006.01)

(52) U.S. Cl.
CPC ..... *F04D 29/058* (2013.01); *F04D 29/584* (2013.01); *F04D 29/5806* (2013.01)

(58) Field of Classification Search
CPC ..... F04D 13/086; F04D 13/12; F04D 13/14; F04D 25/00; F04D 25/02; F04D 25/06; F04D 25/0686; F04D 25/16; F04D 29/002; F04D 29/007; F04D 29/58; F04D 29/5806; F04D 29/582; F04D 29/5826; F04D 29/5833; F04D 29/5846; F04D 29/586; F04D 29/5866; F04D 29/5873; F04D 29/5886; F04D 25/0606; F04D 29/058; F04D 29/584
USPC ..... 417/321, 357, 366–370, 372, 410.1, 417/423.1, 423.3, 423.4, 423.5, 423.7, 417/423.8, 423.12, 424.1, 424.2
See application file for complete search history.

(56) References Cited

U.S. PATENT DOCUMENTS

2013/0136622 A1 5/2013 De Bernardi et al.
2014/0241907 A1* 8/2014 Grynning ..... F04D 13/086 417/53
2017/0074268 A1* 3/2017 De Kerpel ..... F04C 29/04

OTHER PUBLICATIONS

International Search Report and Written Opinion issued in connection with corresponding PCT Application No. PCT/EP2016/061271 dated Jun. 14, 2016.
International Preliminary Report on Patentability issued in connection with corresponding PCT Application No. PCT/EP2016/061271 dated Nov. 28, 2017.

* cited by examiner

COOLING SYSTEM FOR COOLING A MOTORCOMPRESSOR UNIT

BACKGROUND OF THE INVENTION

Embodiments of the present invention relate to a cooling system for cooling a motorcompressor unit for processing a working fluid.

The cooling system of embodiments of the present invention is particularly conceived for improving the efficiency of motorcompressor for subsea applications, but any other motorcompressor may be considered.

Integrated motorcompressor units here considered comprise, integrated in a casing, a motor and a compressor.

Generally a motorcompressor unit of the type here considered comprises a centrifugal compressor processing a process gas, the compressor being arranged in a housing together with a motor, usually consisting of an electric motor.

The compressor of the motorcompressor unit could be fluidly connected with an external separator machine placed between the well and the inlet of the unit. A separator device is present also inside the casing at the inlet of the compressor.

The motorcompressor unit of the kind of embodiments of the present invention comprises a motor which drives the compressor via a shared rotating shaft supported on each end by magnetic bearings. Said shaft connect the rotor of the electric motor and the rotor of the centrifugal compressor on which are installed the impellers of the compressor, said shaft usually does not project outside the casing(s). The compressor generates a flow of compressed process gas.

When used to directly drive a compressor, such as a centrifugal compressor, the shaft is required to rotate at relatively high speeds. In addition to the heat generated by the electrical loss mechanisms that are characteristic of electric motor drivers, operating the motorcompressor device at high speeds increases windage frictional losses generated by the rotating components.

Motorcompressor units used in the production or transport of hydrocarbons are provided with a shared rotating shaft supported by a rotor-bearing system.

In case of electric motor, heat is also generated by the electrical systems that are characteristic of electric motor drivers. Heat is also generated through the windage friction resulting from the rotating components operating in pressurized gas.

If this heat is not properly dissipated, it negatively affects the performance of the motor and can damage the insulation of the stator. Increased temperatures can also adversely affect the rotor-bearing systems of both the compressor and motor, thus leading to bearing damage and/or failure.

For cooling the motor and bearings in a motorcompressor unit, is provided a cooling circuit which may be an open loop cooling circuit or a quasi-closed-loop cooling circuit where gas is drawn from the process stream at some point in the compression process.

An example of such cooling circuit is shown in FIG. 1.

Only a small amount of process gas is fed into the cooling circuit from the process stream. The quasi-closed-loop cooling circuit often uses a small blower to circulate the cooling gas through the cooling circuit. In subsea applications, the cooling gas is typically cooled in a sea water-cooled heat exchanger.

This process gas is then passed through the motor and bearing areas to absorb heat.

According to the current art, motorcompressor unit, in particular motorcompressor for subsea applications, uses as cooling media the process gas which may be cooled through an external cooler.

In these applications the cooling gas may be circulated in a quasi-closed loop: the process gas of the compressor is used to cool the bearing of the rotary shaft positioned at the compressor and the intermediate diaphragm positioned between the motor and the compressor.

The process gas then enters the motor area where a blower pressurizes the gas and forces it to flow into cooling ducts, thus cooling the bearings provided inside the motor area and the motor itself. The process gas is then circulated through an external cooler where is cooled.

When the machine works at low-medium pressure, the cooling efficacy is still good using the same process gas handled by the machine in a quasi-closed loop described above. When the machine works at high pressure, the cooling efficacy of the process gas would be higher due to the increasing of the gas density, but on the other hand, over a certain level of pressure, the windage losses of the motor becomes very high due to the gas density, consequently a very high rate of the electric power which operates the motor is lost for moving the process cooling gas inside the motor area of the machine, and the cooling method becomes ineffective.

SUMMARY OF INVENTION

Embodiments of the present invention relate to a system and method for cooling a high pressure motorcompressor unit for processing a working fluid.

According to embodiments of the present invention, a motorcompressor unit for processing working fluid comprises, integrated in a single unit housed in a case, a motor and a compressor, the compressor having a fluid intake.

In order to give purely indicative values, a low pressure motorcompressor unit may work with an inlet pressure of about 20-140 bar and an outlet pressure of about 70-210 bar, a high pressure motorcompressor may work with an inlet pressure of about 70-200 bar and an outlet pressure of about 300-350 bar. These pressure values are purely indicative because they depend on the working conditions on site.

The cooling system according to embodiments of the present invention comprises a second motorcompressor unit and at least a first duct fluidly connecting an process fluid extraction point located on said second motorcompressor unit to at least one process fluid injection point located on the first motor area of said first motorcompressor.

In an operative condition of the cooling system according to embodiments of the present invention, the process fluid at said extraction point of said second motorcompressor unit has a pressure value lower than the intake pressure value of the first motorcompressor.

The cooling system of embodiments of the present invention therefore comprises two motorcompressor units, in an embodiment, but not necessarily, the two motorcompressor units are in series: the fluid discharge of the second, low pressure, motorcompressor is fluidly connected by means of a fluid connection to the inlet of the first, high pressure, motorcompressor. A heat exchanger is in an embodiment provided on said fluid connection connecting in series the two motorcompressors.

BRIEF DESCRIPTION OF THE DRAWINGS

Further details and specific embodiments will refer to the attached drawing, in which.

DETAILED DESCRIPTION

The following description of an exemplary embodiment refers to the accompanying drawings. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various point of the specification is not necessarily referring to the same embodiment. Further, the particular features, structures or characteristics may be combined in any suitable manner in one or more embodiments.

Figure 2:
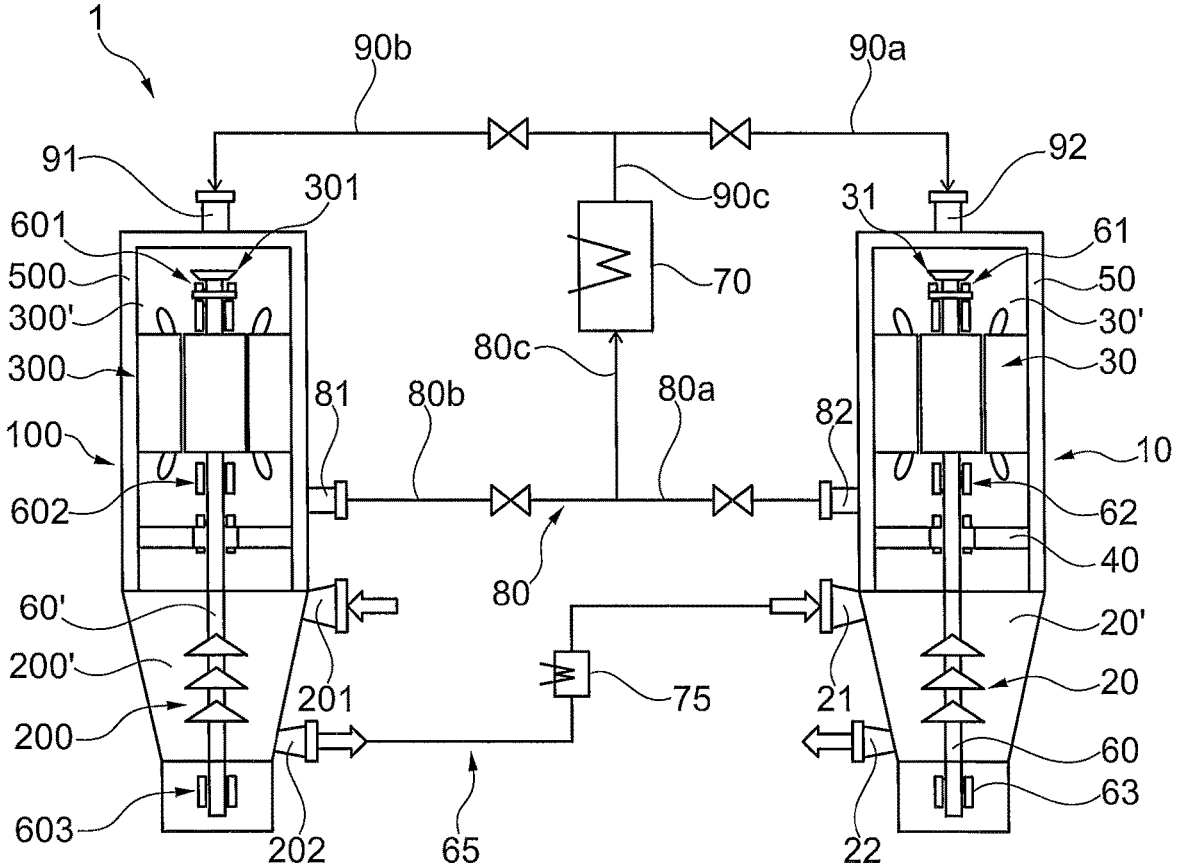
FIG. 2 is a section side schematic view of a cooling system according to an embodiment.

With reference to FIG. 2, it is shown a cooling system 1 according to an embodiment of the present invention comprises a first integrated motorcompressor unit 10 in turn comprising a compressor 20 and a motor 30, in an embodiment an electric motor, directly connected to said compressor 20, which are integrated in a single unit.

The first motorcompressor unit 10 comprises a box or casing 50 in which said compressor 20 and said electric motor 30 are housed. The casing 50 may be realized in a single piece or, alternatively, it may comprise multiple parts.

Said first compressor 20 and said electric motor 30 are in an embodiment separated by an intermediate diaphragm 40 thus avoiding that process gas comprising solid and/or liquid particles could pass from the compressor into the motor area and providing at the same time a fluid seal.

Accordingly, a first compressor area 20' in which said first compressor 20 is located and a first motor area 30' in which said motor 30 is located, can be identified inside said casing 50.

Said first motor 30 and said first compressor 20 are both coupled to the same first axial shaft 60. Alternatively, said first compressor 20 could be coupled to a first shaft portion and said first motor 30, particularly the rotor of said motor, could be coupled to a second shaft portion, the two shaft portions being connected by means of a joint.

The motorcompressor unit 10, in an embodiment, comprises three radial bearings, a first bearing 61, a second bearing 62 and a third bearing 63, for supporting the rotor of the electric motor 30 and the rotor of the compressor 20 and one axial bearing.

In an embodiment, said first compressor 20 and said first motor 30 are coupled to the same first shaft 60, or to a plurality of shaft portions joined together, therefore the first motor 30 and the first compressor 20 are not completely separated, and the process gas processed by the compressor may pass from the first compressor area 20' to the first motor area 30' depending on the fluid seal provided by the first diaphragm 40.

Figure 1:
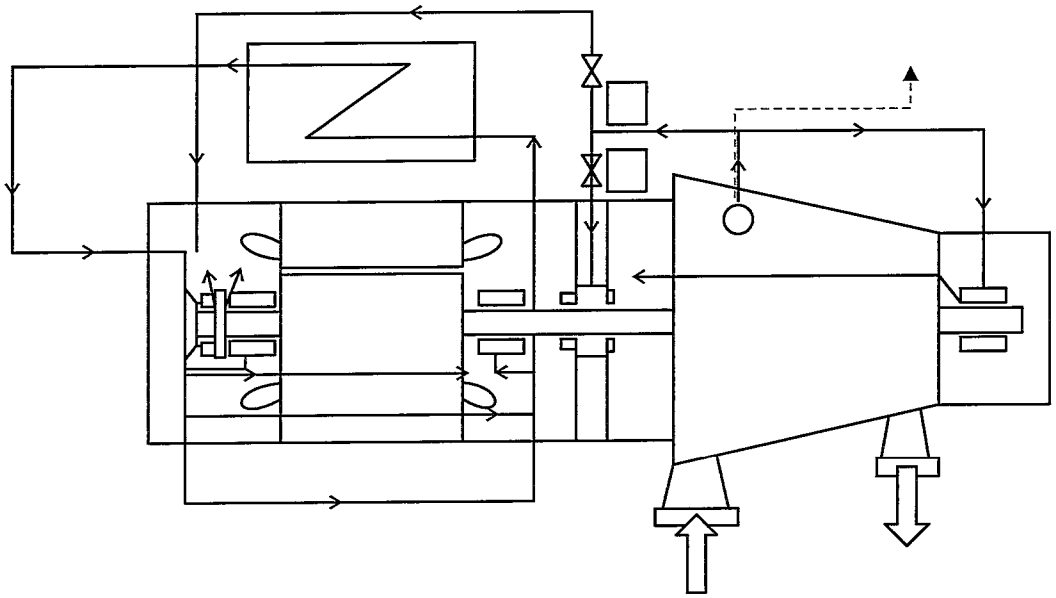
Fig. 1 PRIOR ART
FIG. 1 is a sectioned side schematic view of a typical quasi-closed cooling loop of a motorcompressor unit according to the current art.

In the current art, the process gas is also used for cooling the motor: for cooling the motor and bearings in the motorcompressor unit 10 a quasi-closed loop cooling circuit, wherein gas is drawn from the process stream, is provided. The reference is to FIG. 1.

The cooling system 1 according to embodiments of the present invention as shown in figures from 2 to 6, further comprises a second motorcompressor unit 100 which in turn comprises a second compressor 200 and a second motor 300, in an embodiment an electric motor, directly connected to said second compressor 200, which are integrated in a single unit.

The second motorcompressor unit 100 comprises a second box or casing 500 in which said second compressor 200 and said second electric motor 300 are housed. Said second compressor 200 and said second electric motor 300 are in an embodiment separated by an intermediate second diaphragm 400 thus avoiding that process gas comprising solid and/or liquid particles could pass from the compressor into the motor area and providing at the same time a fluid seal.

Accordingly, a second compressor area 200' in which said second compressor 200 is located and a second motor area 300' in which said second motor 300 is located, can be identified inside said second casing 500.

With reference to an embodiment shown in FIG. 2, the cooling system 1 according to embodiments of the present invention comprises at least a first duct 80 fluidly connecting an extraction point 81 located at said second motor area 300' of said second motorcompressor 100 to at least an injection point 91 located at the first motor area 30' of said first motorcompressor 10.

Said first duct 80 fluidly connects an extraction point 81 at said second motor area 300' to said first motor area 30' of said first motorcompressor 10, provided that in an operative condition the process fluid pressure value at said extraction point 81 is lower than the intake pressure of the first motorcompressor 10.

Each motorcompressor unit has an intake duct and a discharge duct.

More in details, said first motorcompressor 10 has a first fluid intake 21 and a first fluid discharge 22 for the intake of the process fluid into the first compressor area 20' and the discharge of the process fluid from the first compressor area 20', respectively.

Similarly, the second motorcompressor 100 has a second fluid intake 201 and a second fluid discharge 202 for the intake and the discharge of the process fluid into/from the second compressor area 200'. The second motorcompressor unit 100 in an embodiment comprises three radial bearings, a first bearing 601, a second bearing 602 and a third bearing 603, for supporting the rotor of the electric motor 300 and the rotor of the compressor 200 of said second motorcompressor 100 and one axial bearing.

In the cooling system 1 according to an embodiment of the present invention, the second motorcompressor 100, in particular a connection point 81 located at said second motor area 300' or at said second compressor area 200', is fluidly connected to at least a point of said first motor area 30' of said first motor compressor 10.

In an operative condition of the cooling system 1 according to embodiments of the present invention, the connection point 81 at said second motorcompressor 300 is located at a point of said second motorcompressor in which pressure value of the process fluid is lower than the pressure value of the process fluid at the first intake 21 of said first compressor 20.

The first duct 80 fluidly connects the motor areas 30', 300' of the two motorcompressors 10, 100, thus allowing the pressure value of the process fluid of the first motor area 30' to decrease to about the same pressure value of the process fluid of the second motor area 300' of said second motorcompressors 100, and the process fluid is then re-injected in the motor areas: at a first injection point 92 the process fluid is injected into the first motor area 30', at a second injection point 91 the process fluid is injected into the second motor area 300'.

According to an embodiment of the cooling system of the present invention shown in FIG. 2, the process fluid coming from the first connection point 81 of said second motorcompressor 100 flows through a first segment 80*b* of said first duct 80, and the process fluid coming from a second connection point 82 of said first motor area 30' flows through a second segment 80*a* of said first duct 80. The process fluid coming from the two motorcompressors 10, 100 is cooled by means of a common heat exchanger 70 and re-injected in the motor areas of the motorcompressors.

In an embodiment, the first 80*b* and second 80*a* segment of said first duct 80 merge into a third segment 80*c* which is advantageously provided with a first heat exchanger 70 for cooling the process fluid. Downstream of the first heat exchanger 70 the first duct comprises an output duct which comprises a first common segment 90*c* which diverts through a first re-injection duct 90*a* and a second re-injection duct 90*b* respectively connected to said first motor area 30' at the injection point 92, and to said second motor area 300' at the injection point 91.

Each motor 30, 300 is provided with a fan 31, 301, connected to the axial shaft, adapt to circulate the process fluid into the motor area 30', 300' and into the cooling system 1.

According to an embodiment of the cooling system 1 of the present invention as shown in FIG. 2, the first compressor 20 and the second compressor 200 may be fluidly connected in series by means of a second duct 65 fluidly connecting the two compressors 20, 200.

More in details, the first inlet duct 21 of the first compressor 20 may be connected to the second discharge duct 202 of the second compressor 200 by means of the second duct 65, and a second heat exchanger 75 may be provided on said second duct 65 in order to cool the process fluid which enters the first compressor 20.

The cooling system 1 as above described allows to use the process fluid of a second, low pressure, motorcompressor for cooling the motor of a first, high pressure, motorcompressor. The main requirement of the cooling system is that, in an operative condition, the pressure value of the process fluid contained in the second motor area of said second motorcompressor is lower than the pressure value of the process fluid at the intake of said first, high pressure, motorcompressor.

In fact, due to the presence of the first diaphragm 40, the first compressor area 20' and the first motor area 30' are fluidly sealed, and therefore even if the intake pressure of the first compressor 20 is high, or very high, thanks to the fluid connection provided by the first duct 80 the process fluid pressure inside the first motor area 30' is reduced, and the cooling efficiency increased.

In an embodiment, each duct or branch of the cooling system 1 according to embodiments of the present invention will be provided with isolation valves and/or regulation valves.

Figure 3:
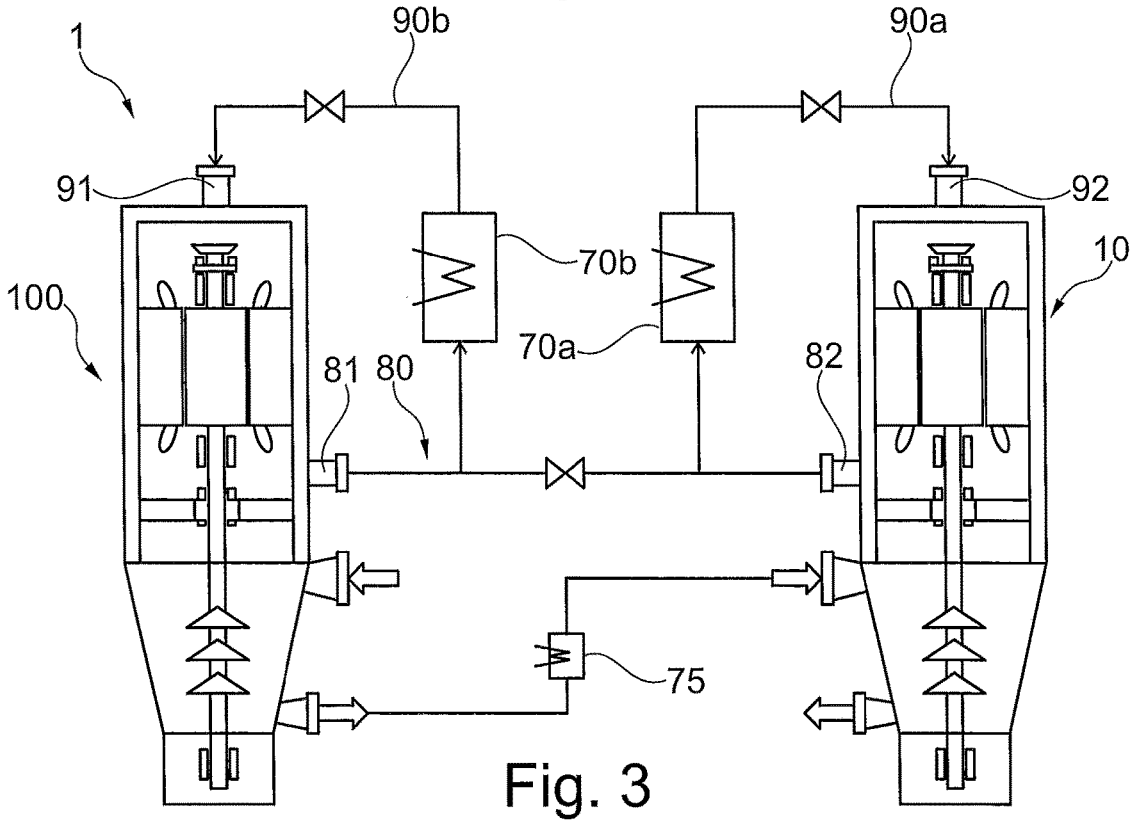
FIG. 3 is a section side schematic view of a cooling system according to an embodiment.

Another embodiment of the cooling circuit 200 according to embodiments of the present invention is shown in FIG. 3.

This alternative embodiment differs from the previous of FIG. 2 in that two separate heat exchangers 70*a*, 70*b* are provided on said first duct 80 fluidly connecting the first 30' and the second 300' motor areas, the other parts of the cooling system 1 remaining unchanged. A quasi-closed loop is realized also in this embodiment as per the one of FIG. 2.

More in details, said first duct 80 comprises a first duct segment 80*a* fluidly connected to said first extraction point 81, and a second duct segment 80*b* fluidly connected to said second connection point 82, the first duct 80 further comprising a first re-injection duct 90*a* connected to said first motor area 30' at the injection point 92 and a second re-injection duct 90*b* fluidly connected to said second motor area 300' at the injection point 91.

One heat exchanger 70*a*, 70*b* is provided on each one of said re-injection ducts 90*a*, 90*b*.

Providing two separate heat exchangers 70*a*, 70*b* allows to minimize their respective overall dimensions.

Figure 4:
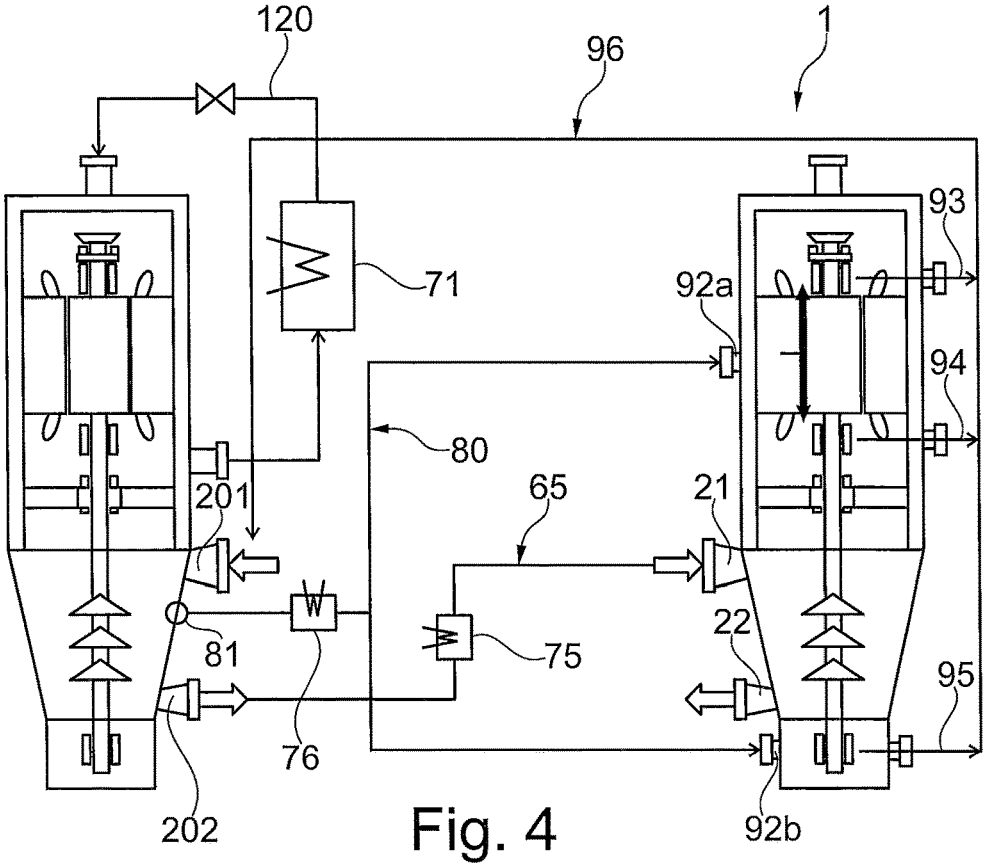
FIG. 4 is a section side schematic view of a cooling system according to an embodiment.

With reference to FIG. 4, an embodiment of the cooling system 1 according to embodiments of the present invention comprises on said first duct 80 fluidly connecting a connection point 81 of said second motorcompressor 100 to at least an injection point at the first motor area 30' of said first motorcompressor 10.

More in details, according to the embodiment of FIG. 4 the extraction point 81 is located at the second compressor area 200' of said second motorcompressor 100, in an embodiment, at the first stage of compression, more particularly downstream of the separator provided inside the second compressor area 200'.

The first duct 80 fluidly connects the connection point 81 on said second compressor area 200' to a first injection point 92*a* provided at the first motor area 30' of said first motorcompressor 10, and to a second injection point 92*b* provided at the first compressor area 20' of said first motorcompressor 10, in an embodiment at said third bearing 63 of said first motorcompressor 10.

According to this embodiment, the process fluid injected into the first motorcompressor 10 through said first injection point 92*a* provided at the first motor area 30' allows to cool the first motor 30 and the first 61 and second 62 bearings of the first motorcompressor 10, the process fluid injected into the first motorcompressor 10 through said second injection point 92*a* provided at the compressor area 20' allows to cool the third bearing 63 of said first motorcompressor 10.

In an embodiment, at least a first heat exchanger 76 is provided on said first duct 80 in order to cool the process fluid coming from the extraction point 81 on said second motorcompressor 100 before the injection of the process fluid into said first motorcompressor unit 10.

According to this embodiment, the second motorcompressor unit 100 comprises a closed-cooling loop: the process fluid is cooled by means of a second heat exchanger 71 provided on a process fluid loop 120 for cooling the process fluid of the second motor area 300'.

On the first motorcompressor unit 10 are further provided one or more return extraction points for the extraction of the heated process fluid from the first motorcompressor 10 in order to return it to said second motorcompressor 100.

More in details, a first return extraction point 93 may be provided at the first bearing 61 of said first motorcompressor 10, a second return extraction point 94 may be provided at the second bearing 62 of said first motorcompressor 10, and a third return extraction point 95 may be provided at the third bearing 63 of said first motorcompressor 10.

The cooling system 1 further comprises a return duct 96 which fluidly connects the return extraction points 93, 94, 95 provided on said first motorcompressor 10 to the second fluid intake 201 of said second motorcompressor 100.

Also in this case, the two motorcompressor units 10, 100 may be connected in series: the first compressor 20 and the second compressor 200 may be fluidly connected in series by means of a second duct 65 fluidly connecting the two compressors 20, 200.

More in details, the first inlet duct 21 of the first compressor 20 may be connected to the second discharge duct 202 of the second compressor 200 by means of the second duct 65, and a second heat exchanger 75 may be provided on said second duct 65 in order to cool the process fluid which enters the first compressor 20.

Figure 5:
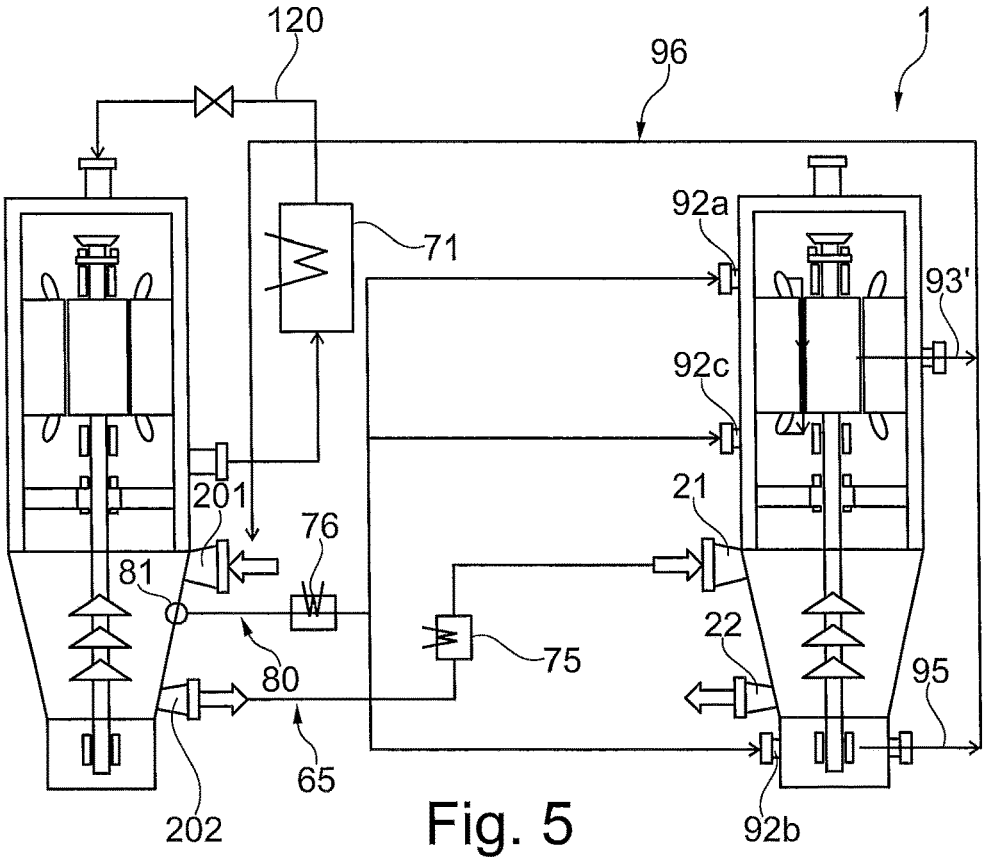
FIG. 5 is a section side schematic view of a cooling system according to an embodiment.
Figure 6:
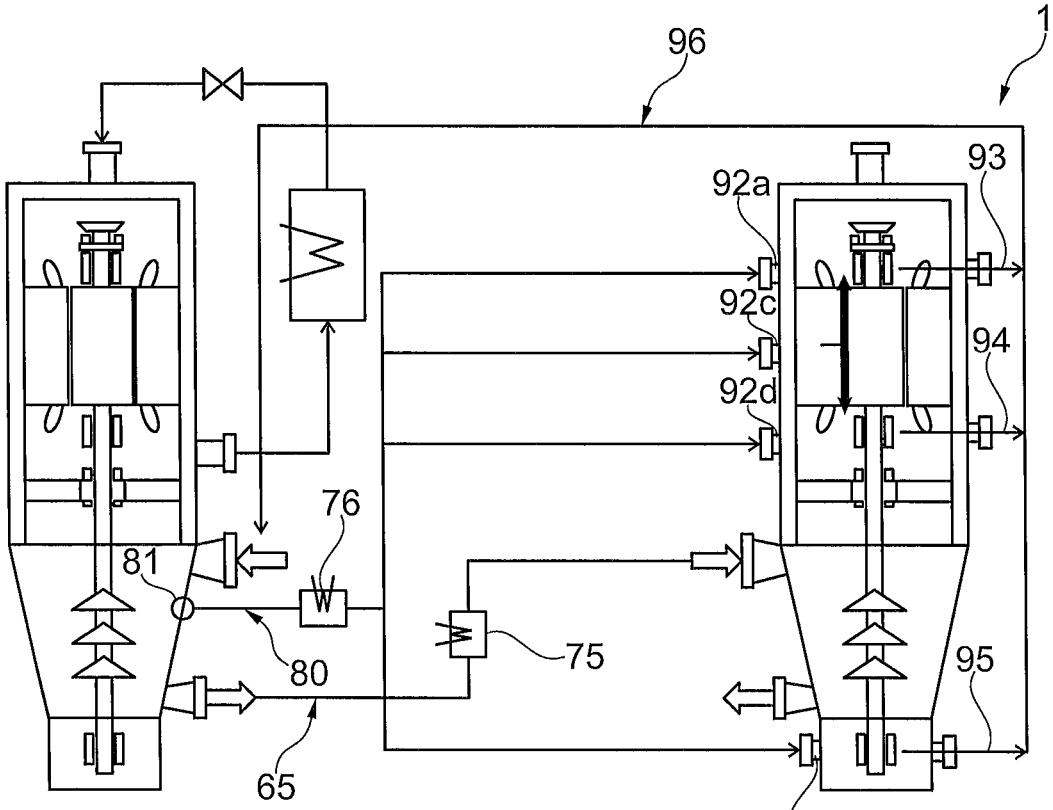
FIG. 6 is a section side schematic view of a cooling system according to an embodiment.

Further embodiments of the cooling system 1 according to embodiments of the present invention are shown in FIGS. 5 and 6 respectively.

Both these embodiments differ from the one shown in FIG. 4 in the number of injection points provided on the first, high pressure, motorcompressor 10.

More in details, according to the embodiment of FIG. 5 the connection point 81 located at the second compressor area 200' of said second motorcompressor 100, in an embodiment at the first stage of compression, more particularly downstream of the separator provided inside the second compressor area 200', is fluidly connected by means of a first duct 80 to a first injection point 92*a* provided at the first motor area 30' of said first motorcompressor 10 and to a second injection point 92*b* provided at the first compressor area 20' of said first motorcompressor 10, in an embodiment at said third bearing 63 of said first motorcompressor 10 for specifically cooling said third bearing 63, a third injection point 92*c* being further provided at the first motor area 30' of said first motorcompressor 10, the first 92*a* and the third 92*c* injection points being dedicated to the cooling of the rotor of the motor 30 and of the first 61 and second 62 bearings.

According to the embodiment of FIG. 5, the first motorcompressor may comprise a reduced number of extraction points, e.g. just one extraction point 93' at the first motor area 30' and a further extraction point 95 at the compressor area 20', at the third bearing 63.

The cooling system 1 further comprises a return duct 96 which connects the return extraction points 93, 95 provided on said first motorcompressor 10 to the second fluid intake 201 of said second motorcompressor 100.

With reference to FIG. 6, another embodiment of the cooling system according to embodiments of the present invention may comprise three injection points 92*a*, 92*c*, 92*d* dedicated to the cooling of the motor 30 and of the first 61 and second 62 bearings, and a further injection point 92*b* at said compressor area 20' dedicated to the cooling the third bearing 63.

As it has been shown, several different embodiments may be conceived without departing from the aim of embodiments of the present invention, and from the scope of protection as defined by the attached claims.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A cooling system for cooling a first motorcompressor unit comprising a casing, a fluid intake, a fluid discharge, a first compressor area defined within the casing, a first motor area defined within the casing, a first compressor located in the first compressor area and a first motor located in the first motor area, the cooling system comprising:
   - a second motorcompressor unit comprising a second motor area; and
   - at least a first duct fluidly connecting a fluid connection point of the second motorcompressor unit to a first fluid connection point of the first motorcompressor unit, the fluid connection point of the first motorcompressor unit located at the first motor area,
   - the at least a first duct comprising:
     - a first duct segment connected to the fluid connection point of the second motorcompressor unit,
     - a second duct segment connected to the fluid connection point of the first motorcompressor unit,
     - a first re-injection duct connected at an injection point to the first motor area,
     - a second re-injection duct connected at an injection point to the second motor area, and
     - two heat exchangers, wherein one of the two heat exchangers is provided on the first re-injection duct and the other of the two heat exchangers is provided on the second re-injection duct.

2. The cooling system according to claim 1, wherein a pressure of a fluid at the fluid connection point of the second motorcompressor unit is lower than a pressure of the fluid at the fluid intake of the first motorcompressor unit.

3. The cooling system according to claim 1, wherein the second motorcompressor unit comprises, a second casing, a second fluid intake, a second fluid discharge, the second motor area which is within the casing, a second compressor area within the second casing, a second motor located in the second motor area, and a second compressor located in the second compressor area.

4. The cooling system according to claim 1, further comprising a return duct fluidly connecting one or more return extraction points provided on the first motorcompressor unit to a fluid intake of the second motorcompressor.

5. The cooling system according to claim 1, wherein the first compressor of the first motorcompressor unit is fluidly connected to a compressor of the second motorcompressor unit in series.

6. The cooling system according to claim 5, wherein a third heat exchanger is provided on a duct fluidly connecting the first compressor and the second compressor.

* * * * *